US009919857B2

(12) United States Patent
Weissbrod

(10) Patent No.: US 9,919,857 B2
(45) Date of Patent: Mar. 20, 2018

(54) WELDING CONSUMABLE PACKAGING

(71) Applicant: Lincoln Global, Inc., City of Industry, CA (US)

(72) Inventor: Paul A. Weissbrod, South Euclid, OH (US)

(73) Assignee: LINCOLN GLOBAL, INC., City of Industry, CA (US)

( * ) Notice: Subject to any disclaimer, the term of this patent is extended or adjusted under 35 U.S.C. 154(b) by 603 days.

(21) Appl. No.: 14/592,259

(22) Filed: Jan. 8, 2015

(65) Prior Publication Data

US 2016/0200497 A1 Jul. 14, 2016

(51) Int. Cl.

| | |
|---|---|
| ***B65D 85/00*** | (2006.01) |
| ***B65D 81/05*** | (2006.01) |
| ***B65D 85/04*** | (2006.01) |

(52) U.S. Cl.

CPC ..... *B65D 81/053* (2013.01); *B65D 85/04* (2013.01)

(58) Field of Classification Search

CPC .... B65D 85/04; B65D 85/053; B65D 85/054; B65D 85/056; B65D 85/057

USPC ..... 206/389, 408, 409

See application file for complete search history.

(56) References Cited

U.S. PATENT DOCUMENTS

| | | | | |
|---|---|---|---|---|
| 3,721,382 | A * | 3/1973 | Cavanagh | B65D 5/4608 206/395 |
| 4,291,806 | A * | 9/1981 | Austin | B65D 5/4295 229/120 |
| 5,249,681 | A * | 10/1993 | Miller | B65D 71/36 206/427 |
| D494,057 | S | 8/2004 | Hightower | |
| 7,077,268 | B2 | 7/2006 | Luber | |
| 7,198,152 | B2 | 4/2007 | Barton | |
| 7,331,457 | B2 | 2/2008 | Cipriani | |
| 7,410,111 | B2 | 8/2008 | Carroscia | |
| 7,748,531 | B2 * | 7/2010 | O'Hara | A61F 13/041 206/389 |
| 8,944,358 | B2 * | 2/2015 | Copp | B65H 55/046 206/409 |
| 2003/0010663 | A1 | 1/2003 | Barton | |

FOREIGN PATENT DOCUMENTS

| | | |
|---|---|---|
| JP | 10-287324 A | 10/1998 |

* cited by examiner

*Primary Examiner* — Steven A. Reynolds
*Assistant Examiner* — Javier A Pagan
(74) *Attorney, Agent, or Firm* — Brad C. Spencer

(57) ABSTRACT

A container for packaging a welding wire on a spool includes a box with opposed first and second face panels that are separated by four vertical side walls. At least one aperture is provided on one of the first and second face panels located at one of the four vertically extending corners. Each aperture is defined by a frangible connection on one of the first and second face panels so that an interior of the box is initially inaccessible. At least one corner reinforcing element is provided that penetrates into the interior of the box via the aperture at one vertically extending corner after said frangible connection of the aperture is breached. The at least one corner reinforcing element engages the spool and forms a vertical support located at the vertically extending corner and between the first and second face panels.

19 Claims, 6 Drawing Sheets

WELDING CONSUMABLE PACKAGING

CROSS-REFERENCE TO RELATED APPLICATIONS

Not applicable.

FIELD OF THE INVENTION

The present invention relates generally to packaging and methods for the shipping of wire, and more particularly to spools wound with welding wire electrodes.

BACKGROUND OF THE INVENTION

In recent times, a substantial industry has been developed around providing coils of electric welding wire in square cardboard boxes. This is because welding has become a dominant process in fabricating industrial and commercial products. Applications for welding are wide spread and used throughout the world. Examples include the construction of ships, buildings, vehicles and pipe lines. Welding is also used in repairing or modifying existing products. Among the various methods of joining metal components, arc welding is one well known and very common process.

Arc welding may employ consumable welding wire, which in some instances may be wound on a spool for ease of dispensing. For purposes of protection during storage and shipping, such spools may be placed in cardboard cartons. Conventional cardboard boxes have been modified by a variety of structural elements in an effort to solve the many and diverse problems experienced by use of these boxes. While such cartons have provided sufficient protection during bulk shipment of spooled electrodes to distributors, the market for direct-to-consumer shipping requires additional safeguards for spools.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a container for packaging a welding wire comprise a box comprising opposed first and second face panels that are separated by four vertical side walls and four vertically extending corners. At least one aperture is provided on the first and second face panels, and is located at one of the four vertically extending corners and is defined by a frangible connection on one of the first and second face panels so that an interior of the box is initially inaccessible. At least one corner reinforcing element comprises a main body and an abutment member. The main body comprises a terminal end, and the abutment member comprises an outer profile that corresponds to a spool containing a coil of welding wire located within said box. The at least one corner reinforcing element penetrates into the interior of the box via the at least one aperture at one of the vertically extending corners after said frangible connection of the at least one aperture is breached. The at least one corner reinforcing element engages an outer perimeter rim of said spool containing a coil of welding wire located within said box.

In accordance with another aspect of the present invention, a container for packaging a welding wire comprises a box comprising opposed first and second face panels that are separated by four vertical side walls and four vertically extending corners, each defining an apex. A plurality of generally triangular apertures are provided on the first and second face panels with at least one located at each of the four vertically extending corners. Each triangular aperture is defined by a frangible connection on one of the first and second face panels so that an interior of the box is initially inaccessible. A plurality of generally triangular corner reinforcing elements are provided that penetrate into the interior of the box via the triangular apertures after said frangible connection of each triangular aperture is breached. The plurality of corner reinforcing elements comprise a main body and an abutment member. The main body comprising a terminal end that includes a projection adjacent to a recess, and the abutment member comprising a curved profile that corresponds to a spool containing a coil of welding wire located within said box. The projection and recess on the main body of a first corner reinforcing element that extends through one triangular aperture of the first face panel is arranged to lockingly engage with the corresponding projection and recess of a second corner reinforcing element that extends through a corresponding triangular aperture of the second face panel.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
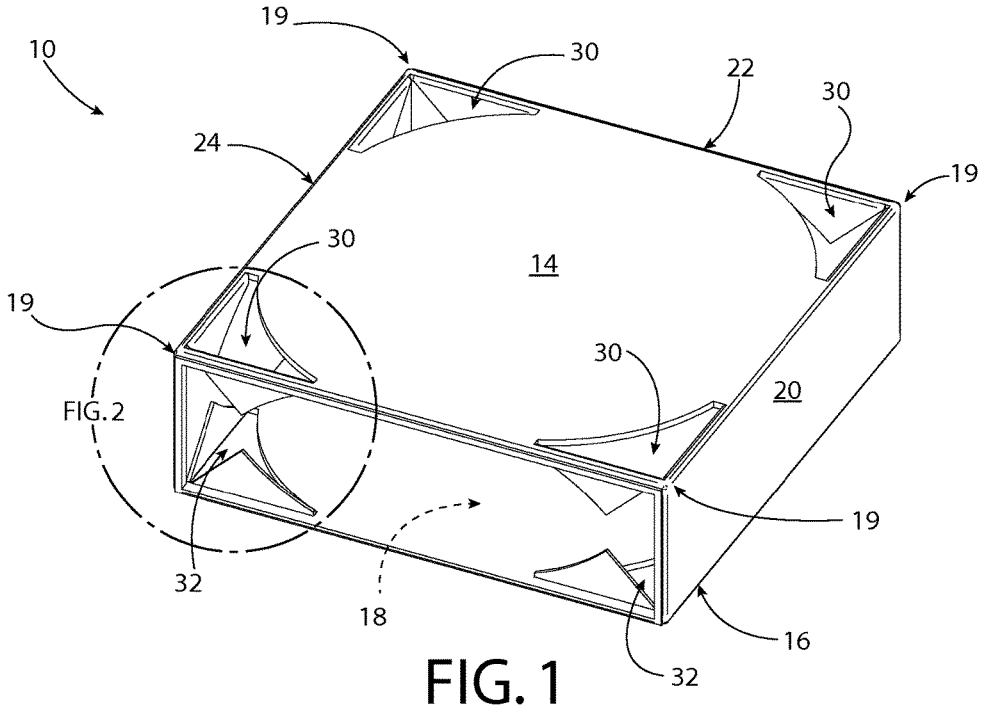
FIG. 1 illustrates a perspective view of one example container for a welding wire.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

It is common for manufacturers to provide coils of consumable welding wire electrodes in square cardboard boxes. However, round wire spools that are packaged in a square carton provide little protection to the edges and faces of the spool during the shipping process. Typical handling by common shipping carriers (i.e., UPS/FedEx) in the package shipping environments (as represented by ISTA-3A testing protocols) can damage the spool and thereby render the spool unable to dispense the welding wire after shipment. For example, the carton wall provides little protection of the spool faces in flat drops, and the round spool face edge has limited contact with the straight carton edge allowing it to easily lance through the carton wall on edge drops. Further, the empty corners of the carton provide only token resistance to crushing in corner drops. Conventionally, the prior art required the spool to be removed from its original labelled carton packaging to be properly packaged for the tougher common shipping carrier environment. Additionally, the prior art required a pre-glued assembly of the overpack components.

In short summary, the structure and method described in the instant application allows the spool to remain in its original labelled carton, but provides access to the corner voids of the carton for the insertion of void-filling cushion components. The inserted elements provide structural strength to the empty corners of the carton in corner drops.

The structure and method used to accomplish the foregoing can have various embodiments. In one example, a conventional spool carton can have nicked, die-cut or score-line features (i.e., a perforation or kiss-cut) that can later be punched inward to create openings in the corners of the carton for insertion of support components that upgrade the structural strength of the package for shipping via common shipping carriers. The result is the formation of an integrated cradle that provides location and cushioning to the spool without having to remove the spool from its original carton packaging, as well as adding structural strength to the previously-empty corners of the carton. After the void filling elements are inserted, a set of foam corner blocks and a corrugate overpack may be used to complete the package. The package may further include a facer plate on each flat face of the original carton to keep the flange faces supported flat in corner drops.

Figure 2:
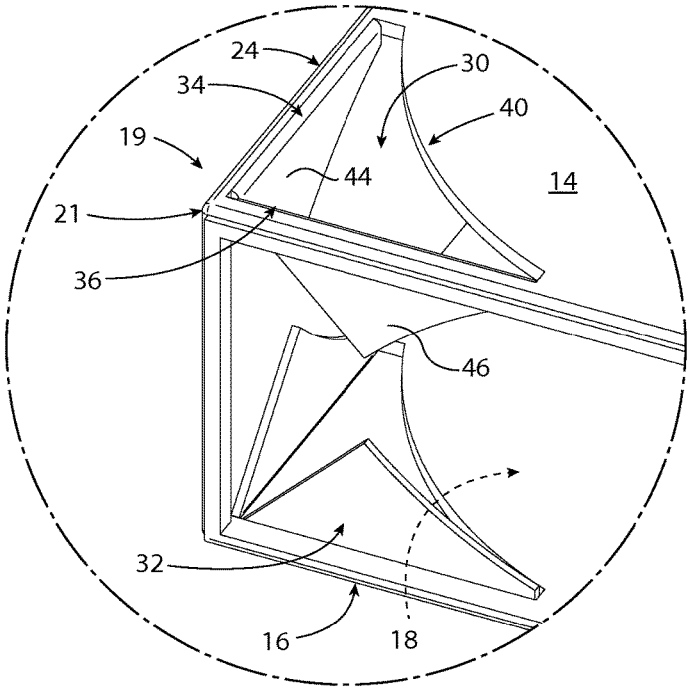
FIG. 2 illustrates a detailed view of FIG. 1.
Figure 6:
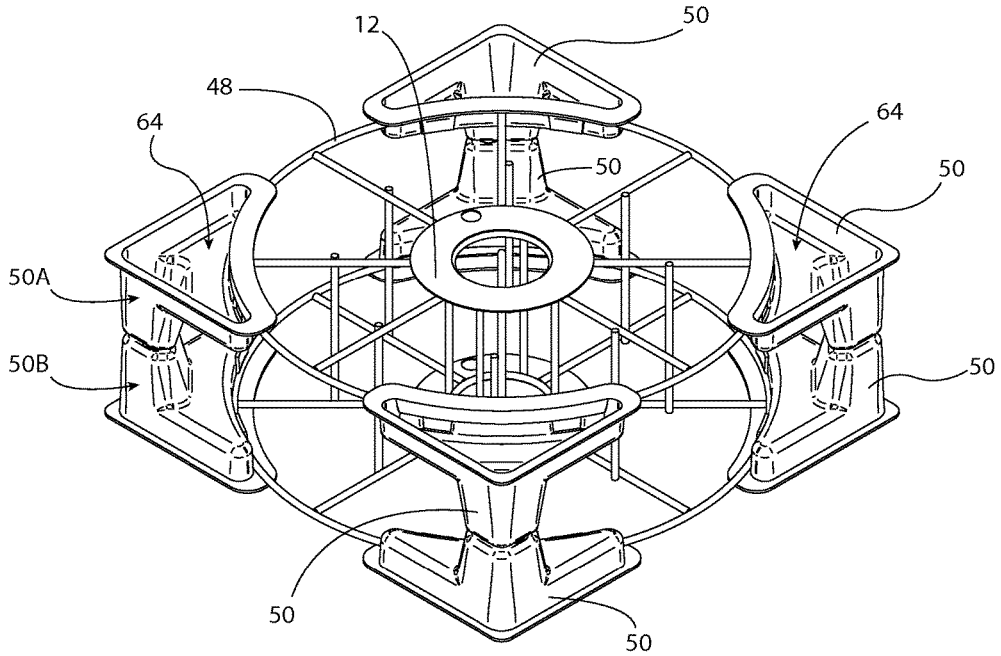
FIG. 6 is similar to FIG. 5, but shows a perspective view.

Turning to the shown example of FIG. 1, an example container 10 for packaging a welding wire is illustrated schematically. Typically, the welding wire is wound in a coil about a round spool 12 (see FIG. 6, wire not shown on spool for clarity), which is ultimately packaged within the container 10. As shown, the container 10 is in the form of a box comprising opposed first and second face panels 14, 16 that are separated by four vertical side walls 18, 20, 22, 24 and four vertically extending corners 19, each defining an apex 21. Preferably, the box is has a square geometry in order to accommodate the round wire spool, although different geometries are contemplated. Preferably, the first and second face panels 14, 16 are connected to the four vertical side walls 18, 20, 22, 24 so that the spool 12 is entirely enclosed within the container 10. As so far described, the container 10 is standard and is constructed as an optimum type of square cardboard container for shipping and unwinding welding wire. However, for the sake of clarity, it is understood that the side wall 18 is not shown in FIGS. 1-2.

The container 10 further comprises a plurality of apertures 30, 32 on the first and second face panels 14, 16 (respectively), with at least one aperture 30, 32 located at each of the four vertically extending corners 19. For the sake of clarity, only the apertures 30 on the first face panel 14 will be described in detail, with the understanding that the apertures 32 on the second face panel 16 can be similar, or even different. Moreover, although the apertures 30 on the first face panel 14 are shown as identical, it is understood that multiple different apertures can be used. Each aperture 30 is bounded on two sides 34, 36 by adjacent side walls of the box (in FIG. 2, for example, the aperture 30 is bounded by side walls 18 and 24). Additionally, the two sides 34, 36 of the aperture 30 extend adjacent to the apex 21 of the associated corner 19.

Although ultimately the apertures 30 will provide access into an interior of the box, each aperture is initially closed-off and defined by a frangible connection on one of the first and second face panels 14, 16 so that an interior of the box is initially inaccessible. The frangible connection of each aperture 30 comprises at least two non-frangible sides that are secured to one of the face panels or vertical side walls to form a pivotable flap once the frangible connection is breached. In the shown example, the two sides 34, 36 are non-frangible to later provide the pivotable flap(s).

Figure 3:
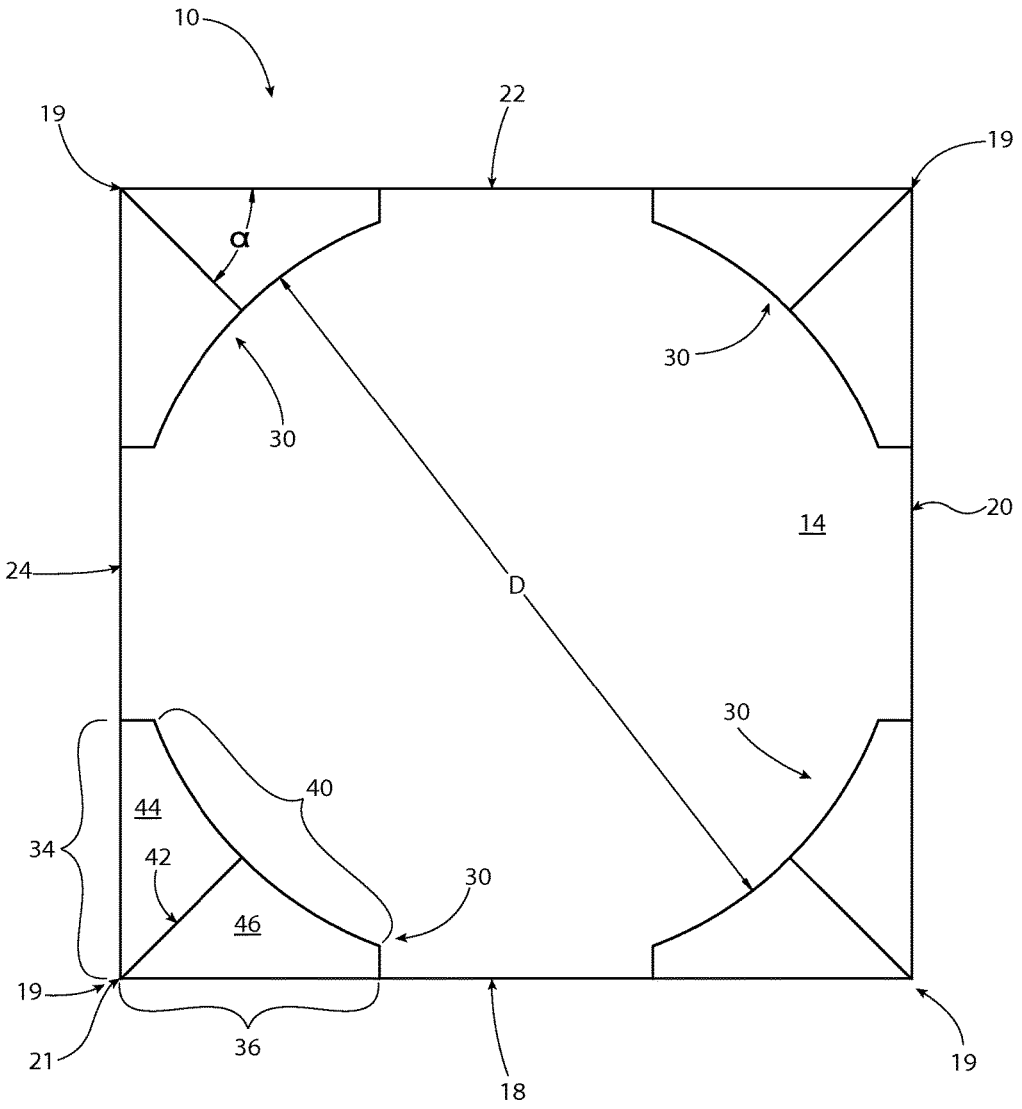
FIG. 3 illustrates a top view of the container of FIG. 1.

Turning to FIG. 3, the frangible connection of each aperture 30 comprises at least one side 40 with an at least partial die-cut or score-line (i.e., a through-cut, a kiss-cut, or a perforated cut). The die-cut or score-line extends along the least one side 40 and either partially or completely through the associated face panel 14. The die-cut or score-line may extend only partially through the face panel 14 so that the container 10 initially retains some structural rigidity about the corners until the frangible connection is breached. Further, whether extending partially or completely through the face panel, the die-cut or score-line may be continuous or dis-continuous. The frangible connection provided by the at least one side 40 allows the aperture 30 to be punched inward, when desired, to create openings in the corners of the carton for insertion of corner reinforcing elements.

As shown in FIG. 3, the at least one side 40 may extend between and connect other sides 34, 36 of the aperture 30. In one example, some or all of these apertures can have a generally triangular geometry, as shown, but other geometries are contemplated (square, rectangle, quadrilateral, polygonal, random, etc.). Additionally, it is understood that the at least one side 40 may be straight or curved. In one example, the apertures 30 may be sized so that the curved sides 40 on opposite corners of the container 10 are spaced apart a distance D that is approximate to the outer diameter of the spool 12. Furthermore, the at least one side 40 may have multiple features, such as a major curved section and two shorter straight sections that ultimately connect to the sides 34, 36.

The frangible connection of each aperture 30 may also comprise an at least partial secondary die-cut or score-line 42 extending to the apex 21 of the associated corner 19 to thereby separate the pivotable flap into a pair of independent pivotable flaps 44, 46. As before, the secondary die-cut or score-line 42 can be a through-cut, a kiss-cut, or a perforated cut, and may be continuous or dis-continuous. The secondary die-cut or score-line 42 can extend completely between the apex 21 of the corner 19 and up to the die-cut or score-line 40 to thereby bifurcate the flap into the pair of independent pivotable flaps 44, 46. In this case, each flap 44, 46 is pivotable into the interior of the container along a respective side 34, 36. As shown in FIG. 3, the secondary die-cut 42 may extend along an angle α of about 45 degrees to exactly bifurcate the flap, or may be provided along a different angle that can provide two differently sized flaps. After the frangible connection of an aperture 30 is breached, the single or multiple flaps are pressed inwardly and are received within the interior of the box.

Figure 4A:
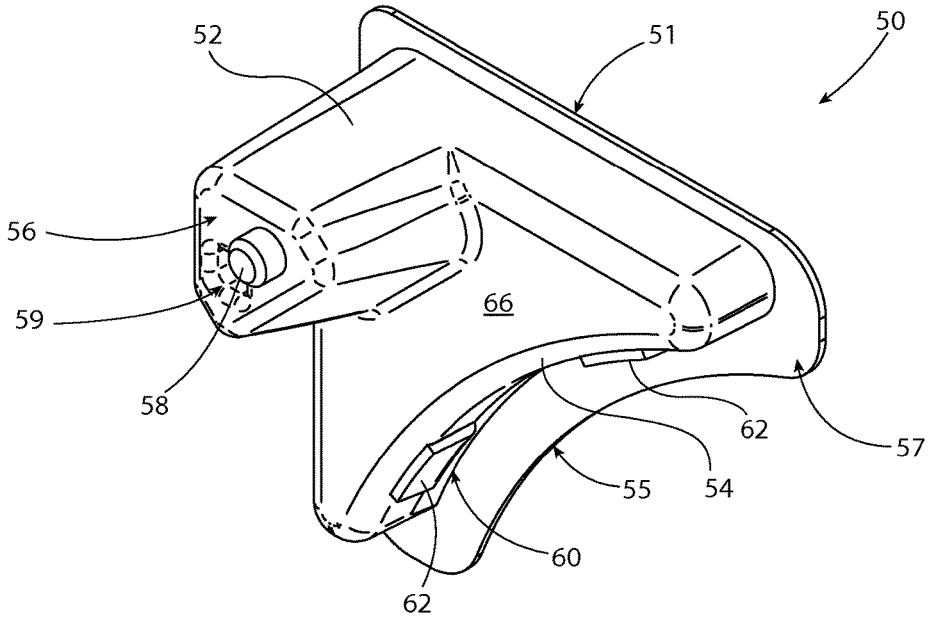
FIG. 4A illustrates a perspective view of one example corner reinforcing element.

Turning now to FIGS. 4A-4D, the container further includes at least one corner reinforcing element 50 that provides structural strength to at least one box corner. The corner reinforcing element(s) 50 are used to rigidify the corners of the container 10, and otherwise maintain the squareness of the box. The at least one corner reinforcing element 50 penetrates into the interior of the box via an aperture 30 after said frangible connection of said aperture is breached. Thus, during assembly, the frangible connection is first breached and then the corner reinforcing elements 50 are inserted to penetrate into the box. Still, it is optionally contemplated that the act of forcibly inserting the corner reinforcing elements 50 into the box can be the mechanism that causes the breach of the frangible connection. In preparation for shipping a coil of welding wire, at least one corner reinforcing element thereby engages an outer perimeter rim of said spool containing a coil of welding wire located within said box. In the illustrated example shown in FIGS. 5-7, a total of eight corner reinforcing elements 50 are used, with four on each of the first and second face panels 14, 16. Still, it is understood that the instant application can be used with various numbers of corner reinforcing elements, such as 1, 2, 4, 8, or other numbers. If only a single corner reinforcing element is used, it is contemplated that it could engage multiple outer perimeter rims (i.e., each rim of the spool adjacent to the first and second face panels 14, 16) on both sides of the spool containing a coil of welding wire located within said box. If multiple corner reinforcing elements are used, then preferably all of the corner reinforcing elements 50 are substantially identical, so as to be cost effective to manufacture. Use of the corner reinforcing elements 50 will serve to reduce the impact on the sidewalls 18-24 of the box from the spool during transportation, and will further distribute impact energy that results from dropping the packaged spool.

Each corner reinforcing element 50 includes a main body 52 and an abutment member 54, and can have various geometries. For example, as shown, the corner reinforcing elements 50 can have three sides arranged in a generally triangular geometry. It is further contemplated that both of the apertures 30 and the corner reinforcing elements 50 will have a complementary geometry. Thus, the two outer sides 51, 53 may correspond to the two sides 34, 36 of the aperture 30 adjacent to the apex 21 of each associated corner 19, while the inner, third side 55 may correspond to the frangible side 40. These sides 51, 53, 55 can form a perimeter corresponding to the geometry of an associated aperture 30. Still, it is understood that various other geometries are contemplated, such as square, rectangle, quadrilateral, polygonal, random, etc.

Additionally, a flange 57 can extend at least partially about the perimeter to abut one of the first and second face panels 14, 16 to accurately position and retain the assembled inserts vertically relative to the spool. The flange 57 also traps the face of the carton after the frangible connections are breached. Further, the flange 57 can also limit an insertion depth of the main body within the box. Preferably, the flange 57 is located at an upper end or surface of the corner reinforcing element 50 and at least partially along each side 51, 53, 55. The flange 57 may be substantially continuous about the perimeter of the corner reinforcing element 50, although it may also be discontinuous. Thus, a corner reinforcing element 50 can be inserted into an aperture 30 until the flange 57 at the upper end contacts the edge of the face panel 14, 16 and/or the side walls 18-24.

The main body 52 extends outwardly from an upper surface to extend through an aperture 30 of the first or second face panel 14, 16, and includes a terminal end 56 with a projection 58 adjacent to a recess 59. The main body 52 preferably has a length of about one-half of a vertically extending corner of the container 10, so that a unitary vertical support is formed between the first and second face panels 14, 16 when the first corner reinforcing element is engaged with the second corner reinforcing element. For example, on an example corner of the container 10 shown in FIGS. 5 and 7, the terminal end 56A of one corner reinforcing element 50A extends through the top face panel 14 to contact the terminal end 56B of another corner reinforcing element 50B extending through the bottom face panel 16. In this configuration, a substantially continuous and unitary support is formed between the two corner reinforcing elements 50A, 50B so that the entire length of the corner is strengthened and rigidified. Preferably, the main body 52 has an outward geometry that complements the interior corner sidewall geometry of the container 10, so as to strengthen the corner along multiple axes and inhibit puncture damage to the spool 12.

Figure 4B:
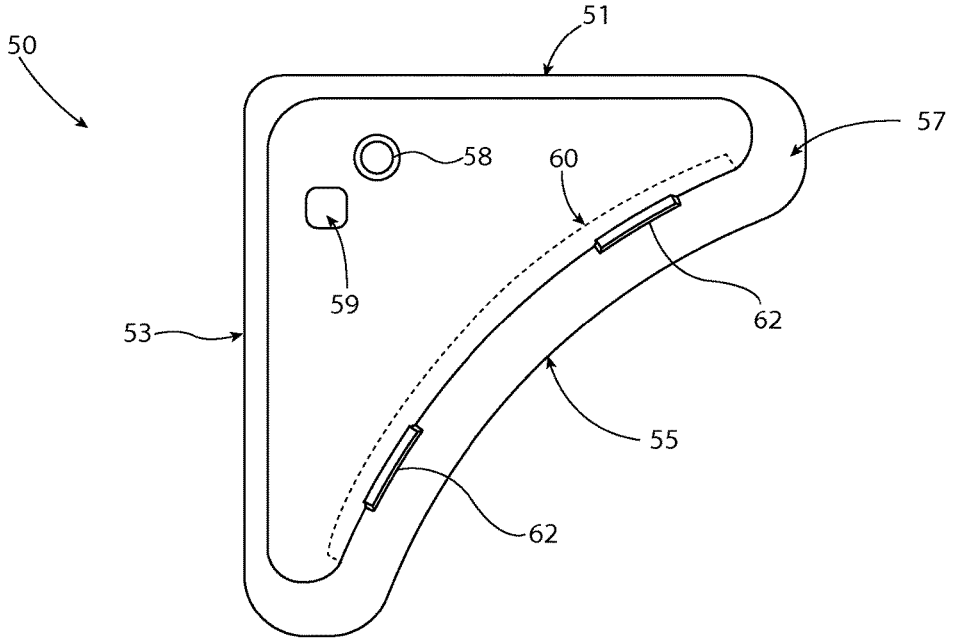
FIG. 4B illustrates a top view of the corner reinforcing element.
Figure 4C:
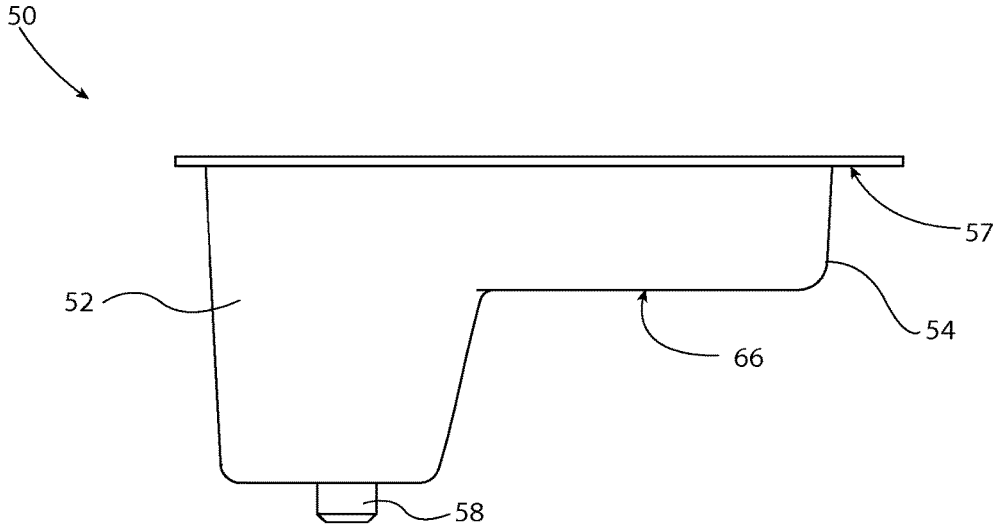
FIG. 4C illustrates a left side view of the corner reinforcing element.
Figure 5:
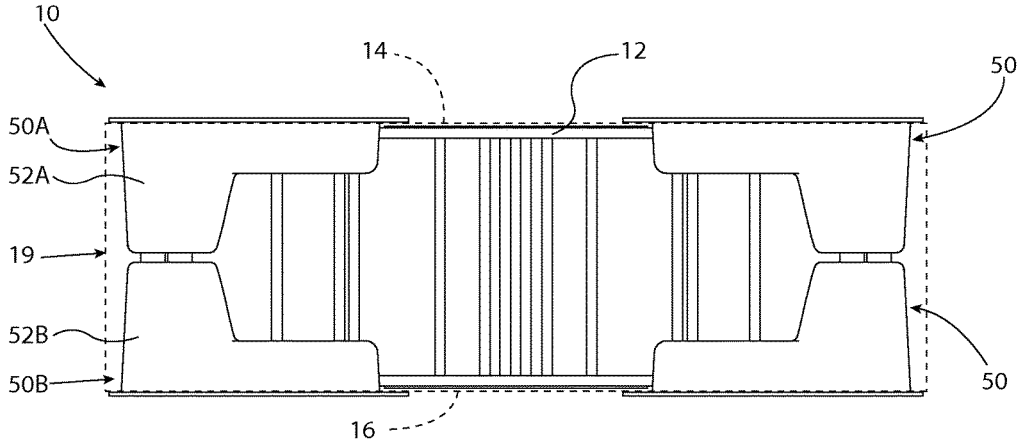
FIG. 5 illustrates a side elevation view of an example welding wire spool located within an example container that includes corner reinforcing elements.

The terminal end of the main body of a first corner reinforcing element is arranged to contact the terminal end of the main body of a second corner reinforcing element. Preferably, these terminal ends will lockingly engage each other. In one example, the projection 58 and recess 59 on the terminal end 56 of the main body 52 are arranged to lockingly engage with the corresponding projection and recess of a second corner reinforcing element. Such a locking connection between the corner reinforcing elements 50 of a single corner 19 can greatly enhance the force loading and force transfer capabilities to thereby provide increased strength at the corners of the container 10. Additionally, the locking connection may help to retain the corner reinforcing elements 50 in place during transportation to inhibit accidental dislodgment. That is, keeping with the example shown in FIGS. 5 and 7, the projection and recess of one corner reinforcing element 50A extending through the top face panel 14 is arranged to lockingly engage with the projection and recess of the corner reinforcing element 50B extending through the bottom face panel 16. The corresponding projection 58 and recess 59 can lockingly engage in various manners, such as by an interference fit, snap-fit, mechanical fasteners, adhesives, heat welding, etc. In one example, as shown in FIG. 4B, an interference fit may be provided by dissimilar geometries, such as where the projection 58 has a generally circular geometry and the recess 59 has a slightly smaller square geometry. Various other geometrical configurations are contemplated. Still, other engagement mechanisms can be utilized to prevent the reinforcing elements 50A, 50B from being separated by the impact to a dropped package. In another example, it is contemplated that the terminal ends 56A, 56B of the reinforcing elements 50A, 50B will lockingly engage each other by a welding operation, such as by heat welding, ultrasonic welding, etc. Such a welding operation could be done with or without the interlocking projection 58 and recess 59.

Each corner reinforcing element 50 further includes an abutment member 54 to contact the outer perimeter rim 48 of the spool 12. The abutment member 54 includes a profile that corresponds to, and is preferably complementary to, an outer perimeter rim 48 of a spool 12 containing a coil of welding wire located within the box. In the shown example, the abutment member 54 includes a curved or angled profile that has a radius substantially the same as that of the outer perimeter rim 48 of the spool 12. In another example, the abutment member 54 may include a curved or angled profile that has a radius slightly less than that of the outer perimeter rim 48 of the spool 12 so as to apply a resilient force upon the spool 12. Such a force, when applied by one or more corner reinforcing elements 50, can help to maintain the spool 12 in the center of the container 10. Still, other profiles are contemplated.

Additionally, the abutment member 54 may include a curved or angled recess 60 (see FIG. 4D) to at least partially receive the outer perimeter rim 48 of the spool 12. The curved recess 60 is spaced a distance interior of the abutment member 54 so as to capture and retain a portion of the outer perimeter rim 48 of the spool 12. The curved recess 60 can extend along substantially the entire length of the abutment member 54, or may have a reduced size as desired. It is contemplated that for each corner reinforcing element 50, the size and geometry of the abutment member 54 and/or the curved recess 60 may be designed to accommodate the distance D that is approximate to the outer diameter of the spool 12 as between two or more corner reinforcing elements 50 arranged at opposite corners of the box.

Figure 4D:
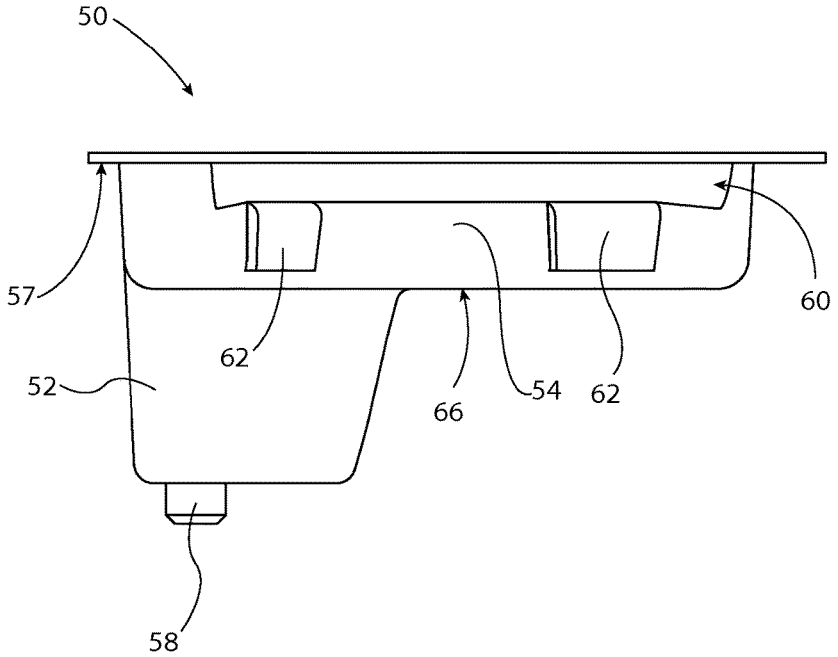
FIG. 4D illustrates a right side view of the corner reinforcing element.

Further, the abutment member 54 may include at least one projection 62 adjacent to and spaced a distance from the flange 57 of the corner reinforcing element 50. Preferably, two or more separate projections 62 are provided. The distance between the flange 57 and an end of the projection 62 is sized to resiliently capture and retain the outer perimeter rim 48 of the spool 12 within the container 10. In one example, the distance between the flange 57 and an end of the projection 62 is at least equal to the thickness of the corresponding first or second face panel 14, 16 and the thickness of the outer perimeter rim 48 of the spool 12. Preferably, the distance is slightly less than this amount so as to provide a resilient capture force upon the spool 12. Further, each projection 62 may further include a ramped geometry. For example, as shown in FIGS. 4A and 4D, an upper end of each projection 62 may be relatively thicker than its bottom end, so as to create a wedge-shaped projection. Such a ramped projection can be beneficial to facilitate insertion of the corner reinforcing element 50 into an aperture 30 while the spool 12 is already located within the container 10. Thus, when a user inserts the corner reinforcing element 50 into the aperture 30, the relatively thinner end of the projection 62 will first contact the spool 12, and insertion is continued until the relatively thicker part of the ramped projection 62 snaps into place under the outer perimeter rim 48 of the spool 12. At this point, the outer perimeter rim 48 should be received within the curved recess 60 of the abutment member 54. In this regard, the projection 62 can further help to guide the outer perimeter rim 48 into the curved recess 60, and once received therein, may help to resiliently maintain the captured connection.

Each corner reinforcing element 50 is preferably formed as a monolithic body, such as by a single plastic mold or the like. This type of construction simplifies manufacturing and increases durability. Still, it is contemplated that each corner reinforcing element 50 can be formed from multiple parts that are secured together to create a unitary body. Furthermore, the upper end or surface of the corner reinforcing element 50 containing the flange 57 may be open or closed. In either event, it can be beneficial for the interior 64 of the corner reinforcing element 50 to be substantially hollow to thereby reduce the amount of material required to manufacture, as well as provide spacing for an impact "crush zone." Thus, if the container 10 is accidentally dropped, the resulting force impact that may occur on a corner 19 of the container 10 may be at least partially absorbed by a deformation of the impact "crush zone." In a similar manner, the main body 52 can be spaced a distance apart from the abutment member 54 and outer rim 48 of the spool 12 to provide a similar crush zone effect, whereby a corner impact force may deform the main body 52 inwards and towards the abutment member 54. Although the interior is substantially hollow, one or more reinforcing ribs or other structural members may be provided. In one example, the hollow interior 64 can be bounded by a connecting wall 66. The connecting wall 66 can be arranged generally perpendicular to the side walls 18-24 of the container 10 so as to provide a strong structural support against side impact forces. The connecting wall 66 may also provide a connection between the main body 52 and the abutment member 54. In one complete example, each corner reinforcing element is formed as a monolithic body with a substantially hollow interior that is bounded by a connecting wall that connects the main body to the abutment member.

Figure 7:
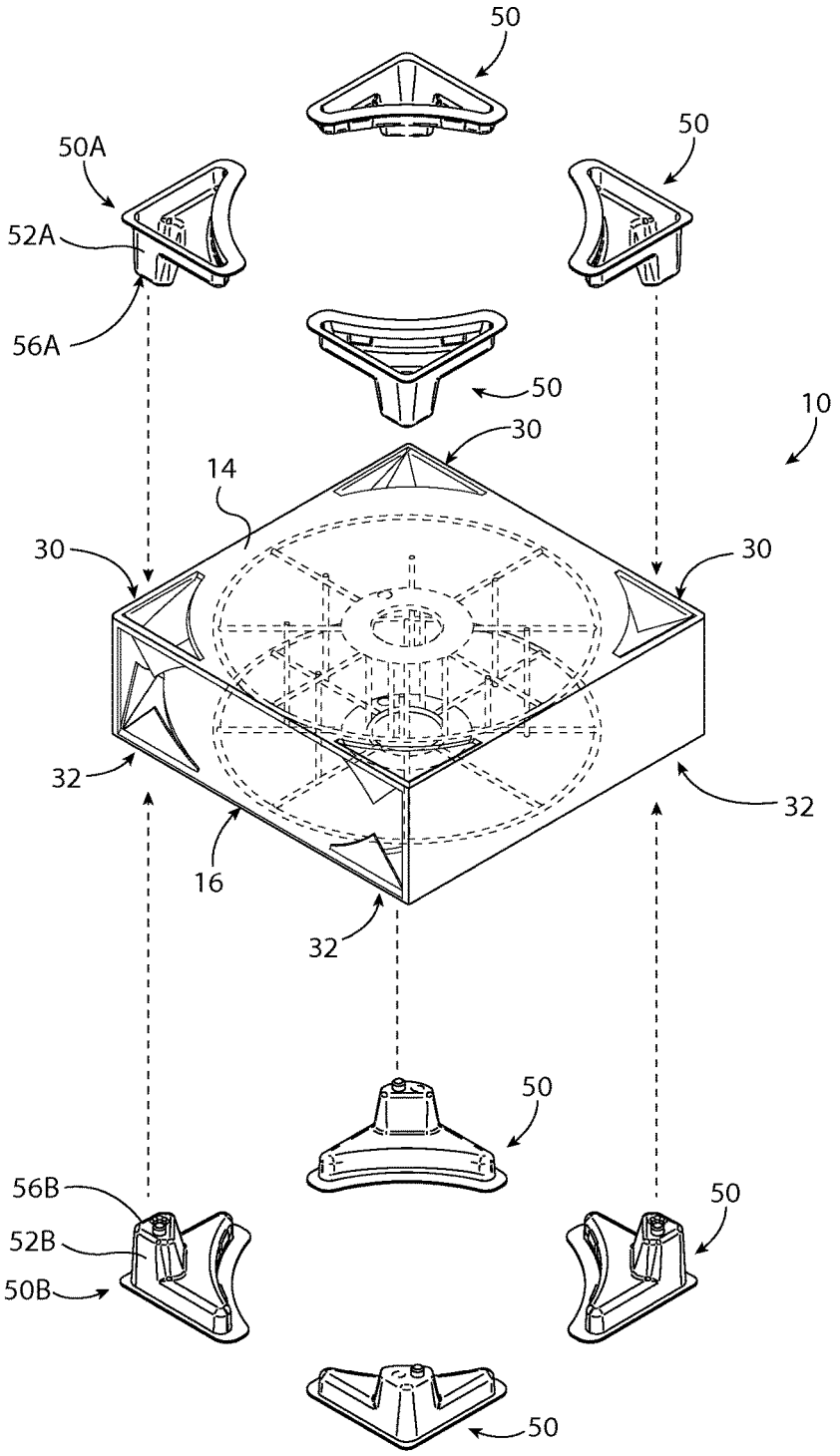
FIG. 7 illustrates an example method of assembling the container with corner reinforcing elements.

Turning now to FIG. 7, one example method of using the corner reinforcing members 50 will be discussed. Initially, a coil of welding wire is wound upon a spool 12 and packaged within a container 10. The first and second face panels 14, 16 of the container 10 include a plurality of apertures 30, 32 (respectively) with at least one aperture 30, 32 located at each of the four vertically extending corners 19. Each aperture is defined by a frangible connection on one of the first and second face panels 14, 16, which is punched inward to create openings in the corners of the carton for insertion of the corner reinforcing elements 50. One corner reinforcing element 50 is inserted into each aperture 30 until the abutment member 54 is in contact with the outer perimeter rim 48 of the spool. Preferably, insertion is continued until the projection 62 clicks into place upon the outer perimeter rim 48 of the spool 12. At this point, the outer perimeter rim 48 should be received within the curved recess 60 of the abutment member 54, and the flange 57 at the upper end contacts the edge of the face panel 14, 16 and/or the side walls 18-24. Preferably, a total of eight corner reinforcing elements 50 are used, with four on each of the first and second face panels 14, 16. For each corner of the container 10, the terminal end 56A of one corner reinforcing element 50A extends through the top face panel 14 to contact the terminal end 56B of another corner reinforcing element 50B extending through the bottom face panel 16. Preferably, the projection and recess of one corner reinforcing element 50A lockingly engages with the projection and recess of the corresponding corner reinforcing element 50B. Once all of the corner reinforcing elements 50 are in place, the container 10 can appear like the example shown in FIGS. 5-6 and is ready for shipment. It is noted that the box is not shown in FIG. 6 for clarity.

Preferably, the container is formed from corrugated cardboard material and the corner reinforcing elements are formed from a plastic material (or even a strengthened paperboard material). After the container is used, all parts of the box can be recycled. Still, other materials are contemplated.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A container for packaging a welding wire, said container comprising:

a box comprising opposed first and second face panels that are separated by four vertical side walls and four vertically extending corners;

at least one aperture on the first and second face panels, located at one of the four vertically extending corners and being defined by a frangible connection on one of the first and second face panels so that an interior of the box is initially inaccessible; and at least one corner reinforcing element comprising a main body and an abutment member, the main body comprising a terminal end, and the abutment member comprising an outer profile that corresponds to a spool containing a coil of welding wire located within said box, wherein, after said frangible connection of the at least one aperture is breached, the at least one corner reinforcing element penetrates into the interior of the box via said at least one aperture at one of the vertically extending corners, and wherein the at least one corner reinforcing element engages an outer perimeter rim of said spool containing a coil of welding wire located within said box, wherein the main body of a first corner reinforcing element that extends through one aperture of the first face panel is arranged to contact the main body of a second corner reinforcing element that extends through a corresponding aperture of the second face panel to form a unitary vertical support located at one vertically extending corner and between the first and second face panels.

2. The container of claim 1, wherein the main body of each corner reinforcing element comprises a terminal end that includes a projection adjacent to a recess, and wherein the projection and recess on the main body of the first corner reinforcing element on the first face panel is arranged to lockingly engage with the corresponding projection and recess of the second corner reinforcing element on the second face panel.

3. The container of claim 1, wherein the frangible connection of each aperture comprises at least one side with an at least partial die-cut or score line.

4. The container of claim 3, wherein the frangible connection of each aperture comprises at least one non-frangible side that is secured to one of the face panels or vertical side walls to form a pivotable flap, and wherein after said frangible connection is breached, the pivotable flap is received within the interior of the box.

5. The container of claim 4, wherein each aperture has a generally triangular geometry, and wherein the frangible connection of each aperture comprises an at least partial secondary die-cut or score line extending to an apex of the associated corner to thereby separate the pivotable flap into a pair of independent pivotable flaps.

6. The container of claim 1, wherein each corner reinforcing element comprises:

a perimeter corresponding to the geometry of each aperture; and a flange extending at least partially about the perimeter to abut one of the first and second face panels and thereby limit an insertion depth of the main body into the box.

7. The container of claim 1, wherein the main body of each corner reinforcing element has a length of about one half the height of a vertically extending corner, so that the unitary vertical support is formed between the first and second face panels when the first corner reinforcing element contacts the second corner reinforcing element.

8. The container of claim 1, wherein the abutment member comprises a curved recess to at least partially receive said spool containing a coil of welding wire located within said box.

9. The container of claim 1, wherein each corner reinforcing element comprises a flange and the abutment member further comprises at least one projection adjacent to and spaced a distance from the flange, wherein the distance between the flange and an end of the projection is sized to resiliently capture and retain said spool containing a coil of welding wire located within said box.

10. A container for packaging a welding wire, said container comprising:

a box comprising opposed first and second face panels that are separated by four vertical side walls and four vertically extending corners, each defining an apex;

a plurality of generally triangular apertures on the first and second face panels with at least one located at each of the four vertically extending corners, and each triangular aperture being defined by a frangible connection on one of the first and second face panels so that an interior of the box is initially inaccessible; and a plurality of generally triangular corner reinforcing elements that penetrate into the interior of the box via the triangular apertures after said frangible connection of each triangular aperture is breached, wherein the plurality of corner reinforcing elements comprise a main body and an abutment member, the main body comprising a terminal end that includes a projection adjacent to a recess, and the abutment member comprising a curved profile that corresponds to a spool containing a coil of welding wire located within said box, and wherein the projection and recess on the main body of a first corner reinforcing element that extends through one triangular aperture of the first face panel is arranged to lockingly engage with the corresponding projection and recess of a second corner reinforcing element that extends through a corresponding triangular aperture of the second face panel.

11. The container of claim 10, wherein said box comprises a corrugated cardboard material.

12. The container of claim 10, wherein the frangible connection of each triangular aperture comprises at least one side with an at least partial die-cut or score line.

13. The container of claim 12, wherein the frangible connection of each triangular aperture comprises at least two non-frangible sides that are secured to one of the face panels or vertical side walls to form a pivotable flap.

14. The container of claim 13, wherein the frangible connection of each triangular aperture comprises an at least partial secondary die-cut or score line extending to the apex of the associated corner to thereby separate the pivotable flap into a pair of independent pivotable flaps.

15. The container of claim 14, wherein after said frangible connection is breached, the pair of independent pivotable flaps are received within the interior of the box.

16. The container of claim 10, wherein each corner reinforcing element comprises:

a perimeter corresponding to the generally triangular apertures; and a flange extending at least partially about the perimeter to abut one of the first and second face panels and thereby limit an insertion depth of the main body within the box.

17. The container of claim 10, wherein the main body of each corner reinforcing element has a length of about one half the height of a vertically extending corner, so that a unitary vertical support is formed between the first and second face panels when the first corner reinforcing element is engaged with the second corner reinforcing element.

18. The container of claim 10, wherein the abutment member comprises a curved recess to at least partially receive said spool containing a coil of welding wire located within said box.

19. The container of claim 10, wherein each corner reinforcing element comprises a flange and the abutment member further comprises at least one ramped projection adjacent to and spaced a distance from the flange, wherein the distance between the flange and an end of the ramped projection is sized so that the end of the ramped projection snaps into place under an outer perimeter rim of said spool containing a coil of welding wire located within said box.

* * * * *